US005230510A

United States Patent [19]

Duclos

[11] Patent Number: 5,230,510

[45] Date of Patent: Jul. 27, 1993

[54] ELEVATED HOSEL GOLF CLUB

[76] Inventor: Clovis R. Duclos, 3661 Venture Dr., Huntington Beach, Calif. 92649

[21] Appl. No.: 879,811

[22] Filed: May 6, 1992

[51] Int. Cl.[5] ..... A63B 53/04

[52] U.S. Cl. ..... 273/80.2; 273/167 A; 273/167 G; 273/167 F; 273/167 J

[58] Field of Search ..... 273/167-175, 273/80 A, 80 C, 80 B, 164.1, 77 R, 77 A, 80.2, 80.6, 187.4, 187.6, 186.2; D21/220

[56] References Cited

U.S. PATENT DOCUMENTS

| | | | |
|---|---|---|---|
| 669,864 | 3/1901 | Simpson | 273/167 G |
| 2,683,036 | 7/1954 | Klein | 273/167 G |
| 2,784,969 | 3/1957 | Brandon | 273/167 GX |
| 3,068,011 | 12/1962 | Sano | 273/169 X |
| 3,079,157 | 2/1963 | Turner | 273/167 A |
| 3,539,184 | 11/1970 | Koorland | 273/167 G |
| 3,810,631 | 5/1974 | Braly | 273/167 FX |
| 3,893,672 | 7/1975 | Schonher | 273/167 JX |
| 3,947,041 | 3/1976 | Barber | 273/167 G |
| 4,345,763 | 8/1982 | Swanson | 273/165 JX |
| 4,632,400 | 12/1986 | Boone | 273/167 K |
| 4,995,609 | 2/1991 | Parente et al. | 273/167 FX |
| 5,060,949 | 10/1991 | Brill | 273/167 EX |

FOREIGN PATENT DOCUMENTS

| | | | |
|---|---|---|---|
| 1078412 | 8/1967 | United Kingdom | 273/167 E |

*Primary Examiner*—V. Millen
*Assistant Examiner*—Sebastiano Passaniti
*Attorney, Agent, or Firm*—Pillsbury Madison & Sutro

[57] ABSTRACT

A golf club with an improved head and hosel design which reduces off-center drag, and corresponding twist, experienced by the head as it traverses through a viscous medium such as sand, high grass, mud, or water. The base of the hosel is formed above its traditional position adjacent the sole of the club and is specially shaped so that the horizontal position of the center of drag of the head remains aligned with the center of percussion of the head even when the club is used to hit a golf ball resting in a viscous medium. This eliminates the twisting moment which usually results from the off-center drag caused by the hosel, and assists a golfer in maintaining the proper ball contact angle during the swing so that the golf ball is less likely to diverge from its intended path.

15 Claims, 2 Drawing Sheets

FIG. 1.
(PRIOR ART)
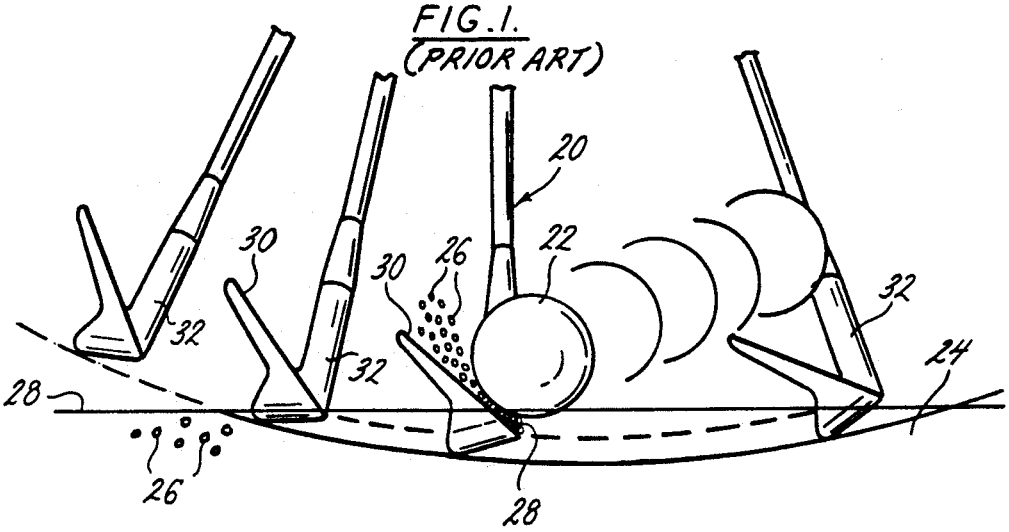
FIG. 2.
(PRIOR ART)
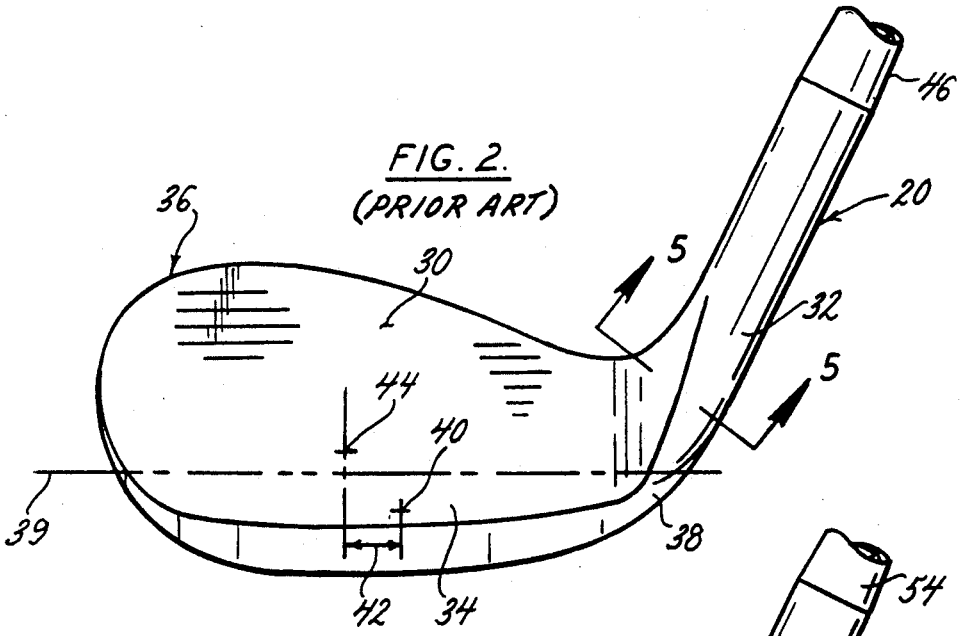
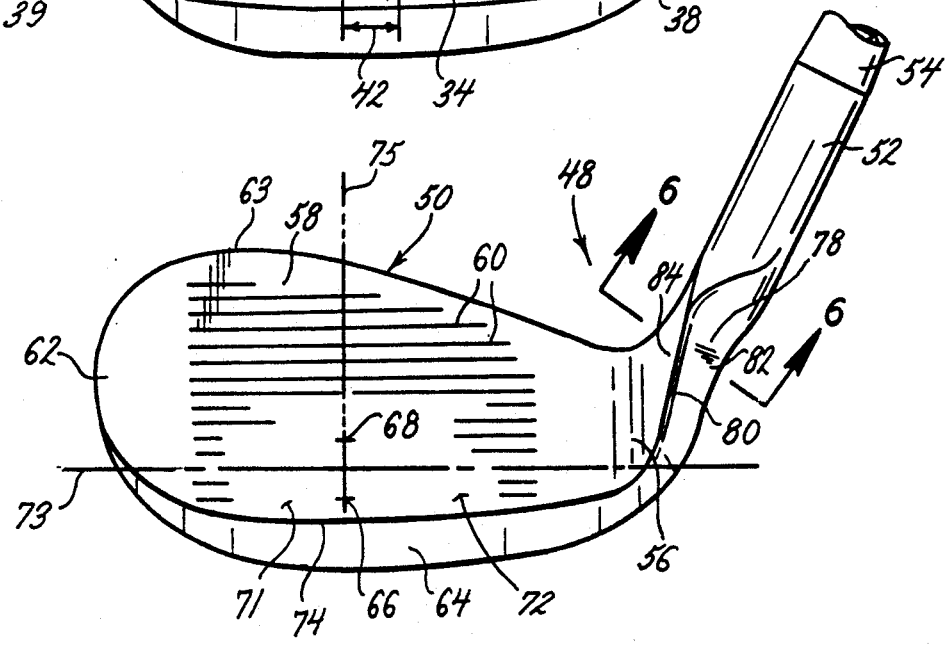
FIG. 4.

FIG. 5.
(PRIOR ART)
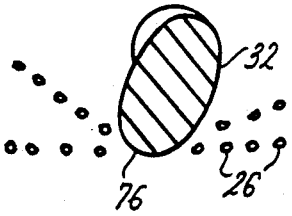
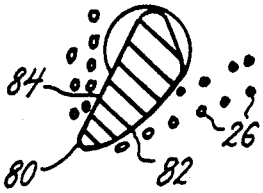
FIG. 6.
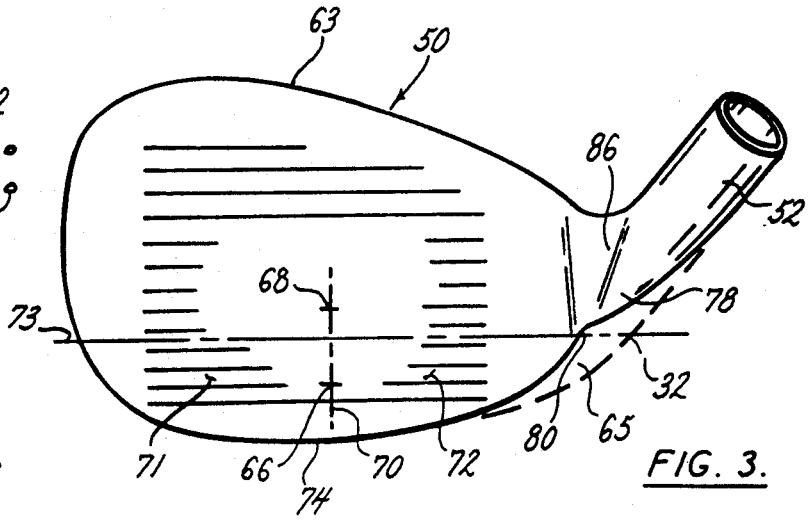
FIG. 3.
FIG. 7.
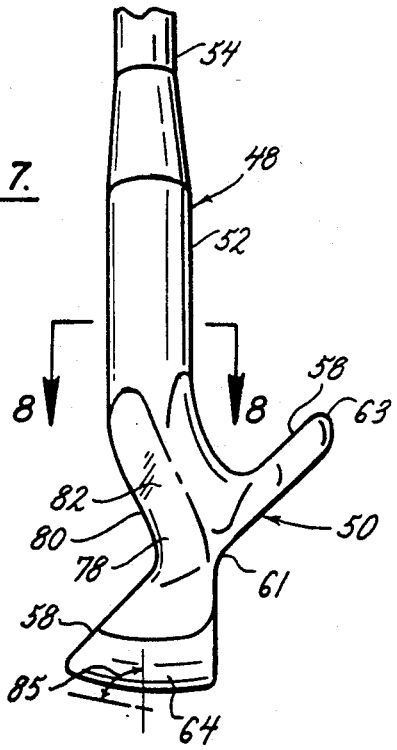
FIG. 9.
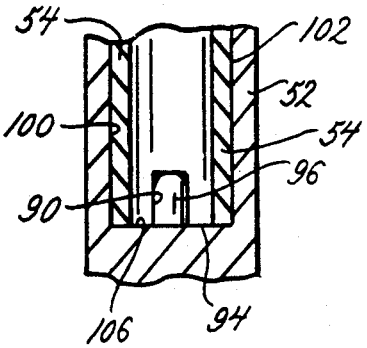
FIG. 8.
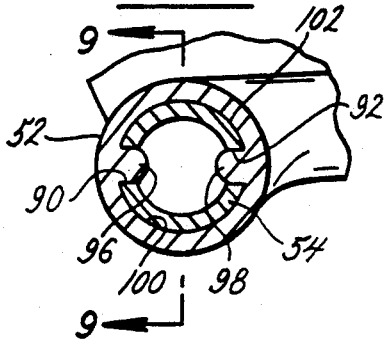

ELEVATED HOSEL GOLF CLUB

BACKGROUND OF THE INVENTION

In the game of golf, a variety of hazards, such as sand traps (also commonly referred to as "bunkers"), tall grass, strategically placed trees and water hazards, are designed into golf courses to make the courses interesting by penalizing golfers who hit errant shots. Golf clubs such as sand and pitching wedges are often used to extricate a golf ball from a hazard by hitting the ball safely onto the green or into the fairway. Usually the golf ball must be hit in an upward direction to escape or avoid such hazards. Therefore, the club faces of traditional sand and pitching wedges are manufactured with large loft angles between the face and the shaft of the club. A large loft angle causes the golf ball to rise quickly from the point of contact with substantial back spin to reduce roll. This combined effect allows the golfer to hit the golf ball out of or over hazards without overrunning the green. For example, if the golf ball is laying next to the green in a sand trap with steep bunker walls, a sand wedge provides the golfer with enough shot versatility to avoid the bunker walls without hitting the golf ball so far that it either flies over the green or rolls off of it.

However, the golfer must still use the golf club correctly before he can celebrate a successful shot, and correct use is not easy. When the golf ball rests in short grass, the head of a golf club should strike the golf ball before striking the ground. Therefore, besides a very slight aerodynamic drag encountered by the golf club as it is swung through the air, virtually no resistance is present on the head of the golf club until contact is made with the golf ball. On the other hand, when the golf ball lies either in high grass or is partially (or totally) embedded in sand, mud or water, the head of the golf club must first come into contact with another medium (certain to be more viscous than air) prior to moving the golf ball. Thus, when a sand wedge is used, as in the previous example, to hit a golf ball out of a sand trap, a portion of the hosel and ball-striking club face becomes emersed in the sand.

When hitting a golf ball out of a sand trap, the golfer is supposed to establish a swing arc that causes the club head to strike the sand a certain distance behind the golf ball and go a certain depth into the sand. In this manner, the club face pushes the sand behind and underneath the golf ball, thereby lifting it from out of the bunker. The difficulty of the shot results from the additional resistance created as the golf club's hosel enters the sand along with the lower portion of the club face. Since the sand is more viscous than air, the extra drag placed on the club head by the hosel causes the horizontal placement of the center of drag of the club head to shift out of alignment with its center of percussion, which in turn results in a sideways twisting of the club face just before the ball is hit, thereby causing the deviation from the intended flight path known as a "hook".

Skillful golfers are aware of the twist effect, although not necessarily the cause of it, generated by the additional hosel drag. They compensate for the twisting moment either by swing, grip or aim adjustment to hit a golf ball out of a hazard, without the golf ball deviating substantially from its intended flight path. However, because the compensation varies with the swing speed, the depth the ball is in the hazard, and the viscous characteristic of the material in which the ball is embedded, doing so successfully and consistently is very difficult, and the average golfer either will not adjust swing, aim or grip to correct for the off-center drag caused by the hazard, or will not factor into the compensation equation intended swing speed and viscous characteristic. Thus, the blade of the club will inevitably twist (counter-clockwise for a right handed golfer) as it meets the off-center resistance, and the golf ball will travel in an unintended direction.

Therefore, there has been a need to provide a golf club which eliminates the need for the golfer to compensate for the additional hosel drag encountered in viscous mediums such as high grass and sand, and which can be used by ordinary golfers to increase their shot accuracy from difficult lies without requiring extraordinary golfing skill.

BRIEF DESCRIPTION OF THE INVENTION

In the present invention, the head with its integral hosel of a "iron" type golf club is designed to reduce twisting moments experienced by the club as it passes through viscous mediums, such as high grass or sand, by matching the center of horizontal drag of the club face to the center of percussion of the club. This is accomplished by elevating the hosel away from the sole of the head so that it does not contribute to the drag of the club during most golf shots.

In most instances when a golf ball is laying in short grass, the face of the club should strike the golf ball first and therefore the inclusion of the present invention is of lesser importance than it is on sand or pitching wedges. However, not all golfers hit a ball properly, and there are times where the golfer uses a "long" iron (one having a small loft angle) rather than a wedge to get out of rough, taking a chance that the ball will cleanly leave the rough in trade for the longer shot distance possible with a long iron. Therefore, the inclusion of the present invention is advantageous in the entire iron set. On the other hand, in cases where the club will hit grass, sand, mud, water, etc., prior to hitting the golf ball, the golfer generally will select either a sand or pitching wedge. Thus, even though this feature can be included in all irons, it is particularly suitable for and advantageous with sand and pitching wedges.

In general, irons, including sand and pitching wedges, are made up of three parts: a shaft having upper and lower ends; a grip at the upper end of the shaft; and a club head at the lower end of the shaft. The club head usually includes a front face for hitting the golf ball, an opposite back surface, a heel at the inner end, a toe at the outer end, and a sole at the bottom. The club head is connected to the shaft at the heel via a hosel. In the present invention, the club head is modified from the conventional head so that the bottom of the heel angles towards the hosel at approximately 45° and merges into the heel approximately one centimeter from the bottom of the club head face. By raising the hosel in this fashion, the club head and hosel can cut through tall grass or sand without experiencing substantial hosel drag, balancing the horizontal center of drag to the horizontal center of percussion where the ball is supposed to strike the ball and eliminating any twisting moment that otherwise would alter the ball-contact angle. In essence, the hosel is lifted so that in most instances only the face comes into contact with the viscous medium.

In addition, the hosel is shaped with a streamlined, generally triangular cross-section with its apex facing forward, instead of the traditional oval, to reduce the frontal surface area of the hosel which is exposed to the tall grass or spraying sand. This improves the fluid dynamics configuration of the hosel to permit the club head to traverse through tall grass or sand with minimal hosel drag. Since the remaining drag, caused by the planform shape of face, does not shift with the normal depths the head is moved through a viscous medium, the club's horizontal center of drag remains coincident with the horizontal location of the center of percussion.

Therefore, it is an object of the present invention to provide a golf club which does not generate a twisting moment when the club head encounters viscous mediums such as high grass or sand.

It is another object of the present invention to provide a golf club with a hosel elevated from the normal position.

It is another object of the present invention to provide a golf club that reduces factors that cause inaccuracy of shots of an average golfer out of difficult lies by eliminating the need for the golfer to compensate for additional hosel drag caused by swinging the club head through high grass, sand, or other viscous mediums.

It is another object of the present invention to provide a golf club with an improved hosel and club head design without decreasing the strength of the club.

It is another object of the present invention to provide an improved golf club that can be manufactured inexpensively and uniformly.

These and other objects and advantages of the present invention will become apparent to those skilled in the art after considering the following specification which discloses preferred embodiments thereof in conjunction with the accompanying drawings wherein:

BRIEF DESCRIPTION OF THE DRAWING

FIG. 1 is an action view of a prior art sand wedge club head encounters the sand prior to contact, if any, with the golf ball;

FIG. 2 is a front elevation view of the head of the prior art sand wedge depicted in FIG. 1;

FIG. 3 is a front elevational view similar to FIG. 2 of a sand wedge head constructed according to the present invention;

FIG. 4 is a front elevational of the sand wedge of FIG. 3 looking directly into the face thereof;

FIG. 5 is a cross-sectional view taken at line 4—4 of FIG. 2 of the hosel of the prior art head depicted in FIG. 2;

FIG. 6 is a cross-sectional view taken at line 5—5 of FIG. 3 of the hosel of the head depicted in FIG. 3;

FIG. 7 is an heel side view of the sand wedge depicted in FIG. 3 showing the location and configuration of the hosel;

FIG. 8 is a cross-sectional view taken at line 8—8 of FIG. 7 showing how the shaft is indexed to the head of the club within the hosel; and FIG. 9 is a cross-sectional view taken at line 9—9 in FIG. 8 which shows the pin configuration of the hosel which supports its connection to the head of the sand wedge depicted in FIG. 3.

DETAIL DESCRIPTION OF THE SHOWN EMBODIMENT

Referring to the drawings more particularly by reference numbers, number 20 in FIG. 1 refers to a sand wedge constructed according to the prior art, it being shown hitting a golf ball 22 out of a sand trap 24. The wedge 20 is shown in 4 positions during a swing: a first position approaching the sand 26 in the sand trap 24; a second position just entering the surface 28 of the trap 24; a third position near its maximum depth in the trap, knocking the ball 22 out of the trap 24; and a forth position exiting the trap 24. As can be seen, a considerable amount of sand 26 is ejected from the trap 24 along with the ball 22. Most good golfers hit such a shot by striking the sand 26 behind the ball 22 and blasting the ball 22 out of the trap 24 with a layer 28 of sand 26 between the face 30 of the club 20 and the ball 22. During the time that the club 20 is moving through the sand 26, not only is the face 30 in contact with and moving sand 26, but also the hosel 32 thereof is displacing sand 26.

As shown in FIG. 2 conventional hosels 32 extend down the lower portion 34 of the face 30 of a club head 36. This causes no difficulties when the club 20 is used to strike a ball 22 on short grass where the ball is struck before the ball 22, since the low hosel position does not effect the golf shot in any way. However, when hitting out of a viscous medium such as sand 26, mud, water, or tall grass, where preferably 15 to 20% of the face 30 is buried before the ball 22 is accelerated thereby, the viscous medium contacts the heel area 38 of the club head 36 which includes the hosel 32. The maximum depth that should be reached by the club head 36 in sand 26 is shown by the horizontal line 39. The effect of the viscous medium on the hosel 32 causes the horizontal position of the center of drag 40 of the club head 36 to be located a horizontal distance, indicated by the arrow 42, from the horizontal position of the center of percussion 44 of the club head 36. The momentum of a swinging club 20 causes the club head 36 to act as though its mass was concentrated at the center of percussion 44. When decelerating in the viscous medium, the club acts like there is a force pulling it forward located at the center of percussion 44. The deceleration caused by passing through the viscous medium acts like a force pulling the head backward at the center of drag 40. Since the center of percussion and the center of drag are not in horizontal alignment, a twisting moment is generated, which when viewed down the shaft 46 of the right-handed club 20, causes a counter-clockwise twisting of the club face 30. Since this twisting starts occurring about the time the club 20 reaches the second position shown in FIG. 1, a substantial amount of twist can occur prior to the time the ball 22 is moved, which with a right-handed club causes the ball to tend to go left or "hook".

A golf club 48 having a club head 50 constructed according to the present invention is shown in FIGS. 3, 4 and 7. Although a "wedge" is shown for illustrative purposes because wedges are most likely to be used when a ball 22 must be hit out a viscous medium, the invention can be used on any "iron" golf club. As shown, the club head 50 has an elevated integral hosel 52 connecting a shaft 54 to the heel 56 of the head 50. The head 50 includes a face 58 with grooves 60 thereon in the area where a golfer is expected to strike a golf ball 22. The hosel 52 is offset forwardly from its connection adjacent the face 58 so that it is generally forward of the rear surface 61 of the head 50. The face 58 extends from the heel to the toe 62 and from an upper edge 63 to a sole surface 64 of the head 50.

FIG. 3 shows, in dashed line, the outline of a conventional hosel 32 with respect to the elevated hosel 52 of the present invention shown in full line. The elimination of area 65, present in the head 32 with a conventional hosel 32, balances the drag of the club head 50 so that its center of drag 66 and its center of percussion 68 lay approximately on the same vertical line 70. The balance is achieved by forming relatively equal face areas 71 and 72 on either side of the center of percussion 68 beneath the line 73 which indicates the preferred maximum depth the face 58 should be buried before the ball is affected by the motion of the head 50. The line 73 and the shape and placement of the intersection 74 between the sole 64 and the face 58 usually defines a total area of desired medium contact of from 6 to 12 $cm^2$ resulting in the areas 71 and 72 each being from 3 to 6 $cm^2$ in size. This area balance about the center of percussion 68 results in a club head 50 which produces little if any twisting about the vertical axis 75 during a golf shot no matter whether the club 48 is used to strike a ball 22 directly or is used to remove the ball 22 from viscous mediums, such as sand, mud, water or tall grass.

When the club 48 is used in viscous mediums, especially sand, mud or water, the medium tends to spray in all directions and a portion of the spray inevitably strikes the hosel 52 of the club head 50. In FIG. 5, which is a cross section of the prior art club head 36, the leading edge surface 76 of the hosel is relatively blunt causing, in this instance, sand 26 that has been deflected by the face 30, to further be deflected at a flat angle by the hosel front surface 76, which causes additional twisting drag. The cross-section of the lower end 78 of the hosel 52 is shown in FIG. 6. The lower end 78 has a relatively sharp leading edge 80 facing the direction of likely sand travel, flanked by two guide surfaces 82 and 84 so that sand 26 or other material moved by the club head 50, is deflected at a much less severe angle to create less drag. The sole surface 64 usually is orientated with respect to the hosel 52 and the shaft 54 at an angle 85 less than 90° so that the head 50 tends to "bounce" upwardly out of any medium such as sand, water, mud or tall grass that it is swung through so that the head 50 does not "dig in" to destroy the balance.

The elevated location of the hosel 52 with respect to the remainder of the club head 50 is made possible by modern club head manufacturing techniques and metallurgy. In prior times, such a club head would have had a tendency to break at the intersection 86 between the heel 56 and the hosel 52 or to feel "soft" to the golfer especially when the club was a sand or pitching wedge where a large face area, the viscous medium and strong swings combine to produce high stress.

Club heads 52 occasionally can accidentally strike a root, rock or other immovable object. Therefore, it is desirable to pin the shaft 54 within the hosel 52 to positively transmit any twisting forces and to prevent relative rotation therebetween. For this reason, as shown in FIGS. 8 and 9, positive anti-twisting means are provided. The means shown include a pair of slots 90 and 92 cut up into the bottom radial surface 94 of the shaft 54. The slots are positioned in mating abutment with a pair of ribs 96 and 98 which extend inwardly from the inner cylindrical surface 100 of the hosel 52. The inner cylindrical surface 100 mates with the outer cylindrical surface 102 of the shaft 54 and is adhesively attached thereto. The positive anti-twisting means assure that the adhesive bond is not over stressed. The ribs 96 and 98 also extend from the bottom inner radial surface 102 of the hosel 52 that abuts the lower radial surface 94 of the shaft 54 and preferably are cast when the head 52 is formed.

Thus there has been shown and described an improved golf club with an elevated hosel which fulfills all of the objects and advantages sought therefore. Many changes, modifications, variations, other uses and applications will become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

What is claimed is:

1. A golf iron club including:

a shaft;

a head having:

a rear surface;

a generally planar face surface in front of said rear surface, said face surface having:

an outer toe end;

an inner heel end;

an upper edge; and a lower edge;

a sole surface extending from said lower edge toward said rear surface;

an integral hosel positioned adjacent said heel end, and spaced from said lower edge;

a center of percussion located at a predetermined position on said face surface; and a center of drag, said face surface being shaped so that said center of drag remains positioned essentially along a vertical line on said face surface aligned with said center of percussion when said head is being moved through a viscous medium up to a predetermined depth, said hosel being positioned up from said lower edge a predetermined distance at least as large as said predetermined depth.

2. The golf iron club as defined in claim 1 wherein said predetermined distance is at least 1 centimeter.

3. The golf iron club as defined in claim 1 wherein said hosel includes:

an upper end portion having:

a generally cylindrical shape having:

a first radius; and a lower end portion connecting said hosel to said heel end, said lower end portion having:

a leading edge region facing both forwardly away from said face surface and downwardly toward said lower edge, whereby: viscous medium is displaced by said generally planar face surface, said leading edge region having:

a second radius substantially less than said first radius.

4. The golf iron club as defined in claim 3 wherein said position of said center of percussion is predetermined by the mass distribution of said club.

5. The golf iron club as defined in claim 1 wherein said face surface has:

a first area positioned below said hosel and to the left of said center of percussion; and a second area positioned below said hosel and to the right of said center of percussion, said second area being essentially equal in size to said first area.

6. The golf iron club as defined in claim 5 wherein the size of each of said first and second areas is in the range of 3 to 6 $cm^2$.

7. A iron club for golf including:

a face surface having:
an inner heel end;
an upper edge; and
a lower edge;
a sole surface extending back from said lower edge; and
an integral hosel positioned adjacent said heel end, said hosel including:
an upper end portion having:
means for attachment to a golf shaft; and
a generally cylindrical shape having:
a first radius; and
a lower end portion including:
a transition region to connect said hosel to said heel end, said transition region having:
a leading edge facing both forwardly away from said face surface and downwardly, toward said lower edge whereby viscous medium displaced by said face surface flows there past with minimum drag, said leading edge having:
a second radius substantially less than said first radius.

8. The iron club for golf as defined in claim 7 wherein said transition region has a generally triangular cross-section with three sides of different length, said second radius being positioned at an intersection of the largest sides of said generally triangular cross-section.

9. The iron club for golf as defined in claim 7 wherein said club has:
a center of percussion located at a horizontal distance from said inner heel end predetermined by the mass distribution of said club; and
a center of drag, said face surface being shaped so that said center of drag is maintained at essentially the same predetermined horizontal distance with respect to said inner heel end as said center of percussion when said head is being moved through sand.

10. The iron club for golf as defined in claim 9 wherein said transition region leading edge is positioned at least one centimeter up said face surface above said lower edge.

11. The iron club for golf as defined in claim 7 wherein said hosel is located a predetermined distance from said lower edge up said face surface, said club having:
a horizontal center of percussion located at a fixed horizontal position on said head; and
a center of drag when said head is being moved through a viscous medium during a normal golf shot, said face surface having:
a first area below said hosel to one side of said center of percussion; and
a second area below said hosel to the opposite side of said center of percussion of essentially the same size and mirror image shape as said first area, so that said horizontal center of drag caused by said areas displacing a viscous medium remains essentially vertically aligned with said center of percussion.

12. The golf iron club as defined in claim 11 wherein each of said first and second areas have a size in the range of 3 to 6 $cm^2$.

13. A golf iron club head having:
a rear surface;
a front surface having:
an outer toe end;
an inner heel end;
an upper edge; and
a lower edge;
a sole surface extending from said lower edge toward said rear surface; and
an integral hosel positioned adjacent said heel end extending forward of said front surface, and spaced from said lower edge, said integral hosel including:
an upper generally circular end portion for connecting said head to a shaft;
a lower end portion connecting said hosel to said heel end, said lower end portion having:
a leading edge region facing both forwardly away from said front surface and downwardly, toward said lower edge said leading edge region having:
a radius which is relatively sharp when compared to said circular upper end portion to reduce drag of any viscous medium flowing there past.

14. The golf iron club head as defined in claim 13 wherein said head has:
a center of percussion whose position is determined by the mass distribution of the golf club of which said head is a part, said front surface being shaped so that below said integral hosel generally equal front surface areas are located on opposite sides of said center of percussion.

15. The golf iron club head as defined in claim 14 wherein each of said generally equal front surface areas has a size in the range of 3 to 6 $cm^2$.

* * * * *